United States Patent [19]

Kennedy et al.

[11] Patent Number: 4,599,034

[45] Date of Patent: Jul. 8, 1986

[54] VEHICLE LIFT

[76] Inventors: Donald L. Kennedy, Adrian, Ga.; John P. Kennedy, Railroad Ave., Clarksville, Ga. 30523; Peggy Kennedy, executrix, P.O. Box 286, Adrian, Ga. 31002

[21] Appl. No.: 688,051

[22] Filed: Dec. 31, 1984

[51] Int. Cl.[4] ..... B66F 7/00

[52] U.S. Cl. ..... 414/678; 254/89 R; 269/71; 269/296

[58] Field of Search ..... 414/678, 779, 782, 359, 414/786, 354, 360, 364, 366, 420, 648, 649, 650, 409, 419, 421; 254/89 R, 89 H, 92; 269/296, 71; 187/8.41, 8.45

[56] References Cited

U.S. PATENT DOCUMENTS

| | | | |
|---|---|---|---|
| 1,487,196 | 3/1924 | Bledsoe | 414/649 |
| 2,857,156 | 10/1958 | Greffe | 414/648 X |
| 3,405,781 | 10/1968 | Brown | 187/8.41 |
| 3,428,191 | 2/1969 | Newswanger | 414/678 |
| 3,591,028 | 7/1971 | McClung, Jr. | 414/421 X |
| 3,734,466 | 5/1973 | Mason | 254/89 |
| 3,850,409 | 11/1974 | Davis et al. | 254/89 |
| 4,046,272 | 9/1977 | Hayward | 414/419 |
| 4,050,673 | 9/1977 | Nishimura | 254/89 |
| 4,295,427 | 10/1981 | Waterman et al. | 414/678 X |

FOREIGN PATENT DOCUMENTS

| | | | |
|---|---|---|---|
| 510428 | 6/1976 | U.S.S.R. | 254/89 H |

*Primary Examiner*—Robert J. Spar
*Assistant Examiner*—Janice Krizek
*Attorney, Agent, or Firm*—Kilpatrick & Cody

[57] ABSTRACT

A lightweight, movable lift usable in pairs for lifting and rotating vehicles to allow easy access to their undersides and engine compartments. A frame and upright slidably support a carriage which is moved up and down the upright by an actuator such as a hydraulic cylinder, compressed air cylinder or mechanically operated jack screw. A vehicle support rack is connected to the underside of each end of the vehicle and to a journal such that the journal is substantially aligned with the center of gravity of the vehicle. The journal is rotatably borne by the carriage as it moves up and down the upright, whereby the vehicle may be easily rotated once it has been lifted a sufficient distance. A follower mounted an appropriate distance radially from the center of rotation of the journal is received and controlled by a follower track mounted on the upright to rotate the vehicle as it is lifted. The lift allows the vehicle to be rotated a full 90 degrees when lifted for easy access to its underside.

8 Claims, 9 Drawing Figures

VEHICLE LIFT

BACKGROUND OF THE INVENTION

This invention relates to a vehicle lift for use with automobiles and other vehicles.

Vehicle repair tasks such as repairing or replacing transmissions, clutches, differential gears, universal joints, brakes, or suspension components often require access to the underside of a vehicle and thus require that a mechanic be underneath a vehicle for long periods of time. Because being underneath a vehicle frequently requires a mechanic to contort his body and to be upside down or have his head back, the mechanic finds it difficult to concentrate for long periods of time and to apply proper torque or purchase to parts or fasteners on which he is working.

Conventional lifts for allowing access underneath vehicles have ranged from tracks with a pit beneath them in which the mechanic may stand, to compressed air actuated lifts frequently found in today's service station bays. Such pits are expensive to install because of the excavation required, and installation of hydraulic lifts allowing standing room is also expensive because of excavation requirements and the expense of components.

Other techniques for allowing access to the underside of vehicles include separate support stands which may be set in place after portions of the vehicle are raised, as well as compressed air actuated bumper jacks which may be moved into place to lift one end of a vehicle. Although such techniques are less expensive than the pit or the larger lift, the mechanic still must work in an awkward position, frequently on his back.

Access to under-hood portions of a vehicle is also often difficult when the vehicle is in the normal position because of the need to lean over fenders or bumpers in order to reach parts being repaired. Removal and replacement of parts is often difficult for the same reasons.

The above-described problems can be solved by lifting and tilting or rotating a vehicle for maintenance and repair. In recognition of this, a few methods have been devised for tilting vehicles when they are lifted, including a two-masted lifting apparatus as disclosed in U.S. Pat. No. 4,050,673 issued Sept. 27, 1977 to Nishimura. This patent teaches the use of a carriage on each mast for supporting the vehicle and a height difference detecting means on the carriages. Both carriages are independently hoisted up and down by separate driving means to raise the vehicle and tilt it.

Another approach is found in U.S. Pat. No. 3,850,409 issued Nov. 26, 1974 to Davis, et al., which teaches a dual jacking device for connection to one end of a vehicle. Two separate independently operated lifting cylinders are attached to the vehicle, one to each side, so that it may be tilted as it is lifted.

Another approach to lift and tilt a vehicle has been to employ a pair of portable cranes, each including a chain hoist, positioned at the front and rear of the vehicle, as disclosed in U.S. Pat. No. 3,428,191 issued Feb. 18, 1969 to Newswanger. Each crane has a portable support assembly for supporting the vehicle in the lifted position and allowing it to be tilted.

None of the above mentioned approaches rotates a vehicle a full 90 degrees. Snowmobiles have been lifted and fully rotated in accordance with U.S. Pat. No. 3,734,466 issued May 22, 1973 to Mason by mounting supporting assemblies on a snowmobile substantially in alignment with its center of gravity and hoisting the rotatably mounted assemblies by means of cables up posts to a position where the snowmobile may be rotated. The manually operated winch devices used to hoist the snowmobile may be inadequate to lift heavy automobiles, trucks or other vehicles, however, and the device in any event requires cranking one winch and then the other in increments with resulting increased labor costs, or the presence of two persons simultaneously cranking the snowmobile up the posts.

SUMMARY OF THE INVENTION

The present invention allows for quick and easy lifting and rotating of vehicles such as automobiles and trucks to allow easy access to their undersides. A lift at each end of the vehicle is supported by a frame which may be provided with wheels for mobility. An upright extends vertically from the frame and supports a sliding carriage. A rotatable journal is mounted on the carriage. The journal is connected by a vehicle support rack to the front or the back of the vehicle in such a manner that the journal is substantially aligned with the vehicle's center of gravity. The other end of the journal carries a follower, which is received by a Y-shaped follower track mounted on the upright, in such a manner that as the carriage slides up and down the upright, the follower is controlled by the track to control rotation of the vehicle. A selector lever at the divergence of the two arms of the track allows the operator to choose which way the vehicle will be rotated. In the preferred embodiment, hydraulic cylinders raise and lower the carriages and are actuated by a single control valve so that the automobile is raised, lowered and rotated in short order with a minimum of effort. Alternatively, compressed air cylinders or electrically powered jack screws may be used.

Because the journals supporting the vehicle in the lifts may be substantially aligned with the vehicle's center of gravity, minimum force is required to rotate the vehicle for presentation of its underside to the mechanic. Unexpectedly, therefore, the follower and follower track need not have strength and structure commensurate with the vehicle's weight; instead, if the journals are properly connected to the vehicle, rotation of the vehicle may be accomplished with force applied by one finger. Also unexpectedly, the fluid leakage resulting from a typical ninety degree rotation of typical vehicles is minimal, and a minimal amount of time is required to drain and fill such fluids. Usually, only the battery need be removed to prepare the vehicle for lifting and rotation.

Accordingly, it is an object of this invention to provide a means by which a vehicle may be hoisted and rotated for easy access to its underside and central portion of the engine compartment.

It is a further object of this invention to provide a vehicle lift which allows a vehicle to be lifted and automatically rotated at least ninety degrees with a minimum of effort by the operator.

It is a further object of this invention to provide a vehicle lift which allows a vehicle to be lifted and rotated and which is light in weight, portable and inexpensive.

It is an additional object of this invention to provide a vehicle lift which allows a vehicle to be lifted and rotated by taking advantage of benefits accrued from lifting the vehicle about its center of gravity so that it may be easily rotated.

It is an additional object of this invention to provide a vehicle lift which allows a vehicle to be lifted and rotated, and in which the lifting and rotation of the vehicle is variably controlled by a single control.

It is an additional object of this invention to provide a vehicle lift which allows lifting and rotation of a vehicle and in which the direction of rotation of the vehicle may be selected.

Other objects, features and advantages of this invention will become apparent with reference to the remainder of the specification, claims and drawings hereof.

DETAILED DESCRIPTION OF THE INVENTION

Figure 1:
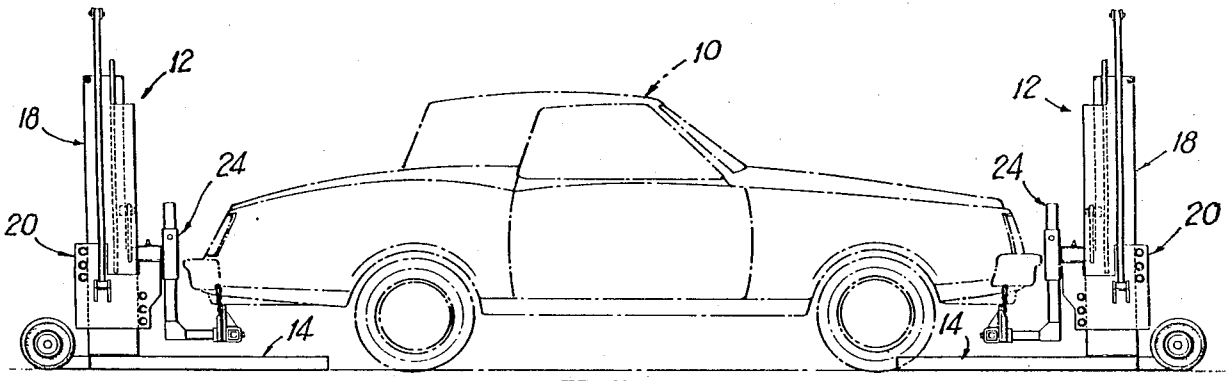
FIG. 1 is a side elevational view of a vehicle being lifted by two vehicle lifts of the present invention.
Figure 2:
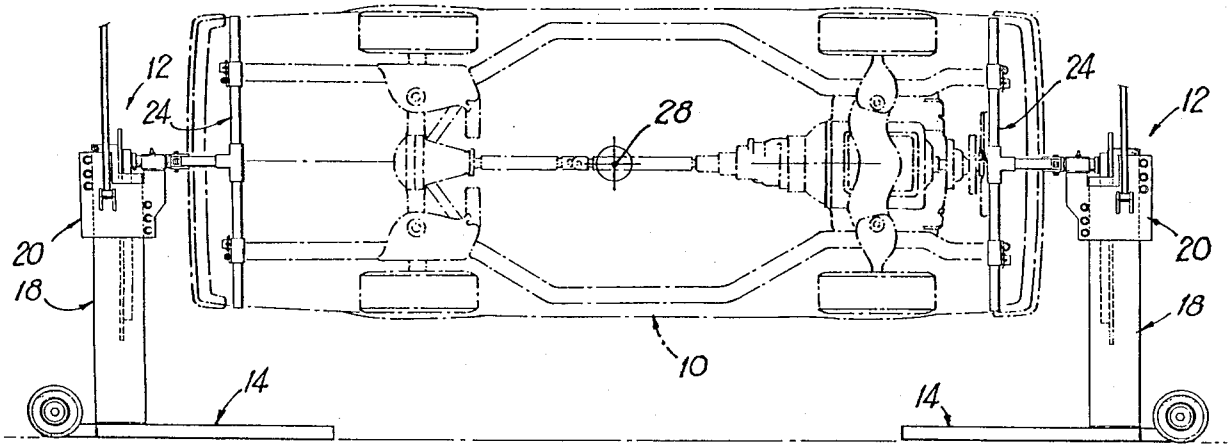
FIG. 2 is a side elevational view of the vehicle of FIG. 1 being rotated by the lifts of FIG. 1.
Figure 4:
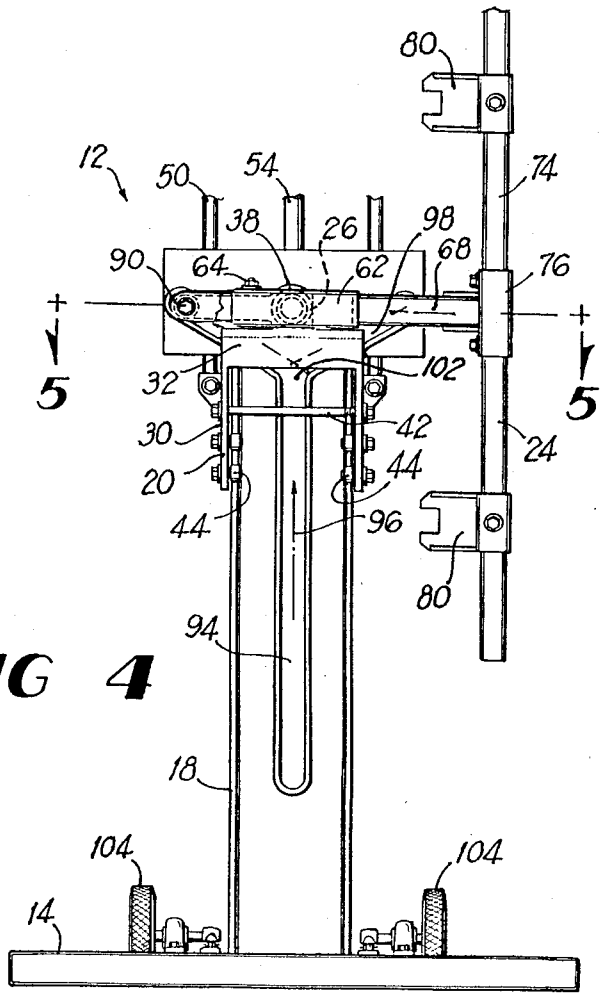
FIG. 4 is a front elevational view of the lift of FIG. 3 with the vehicle support rack in the rotated position.
Figure 3:
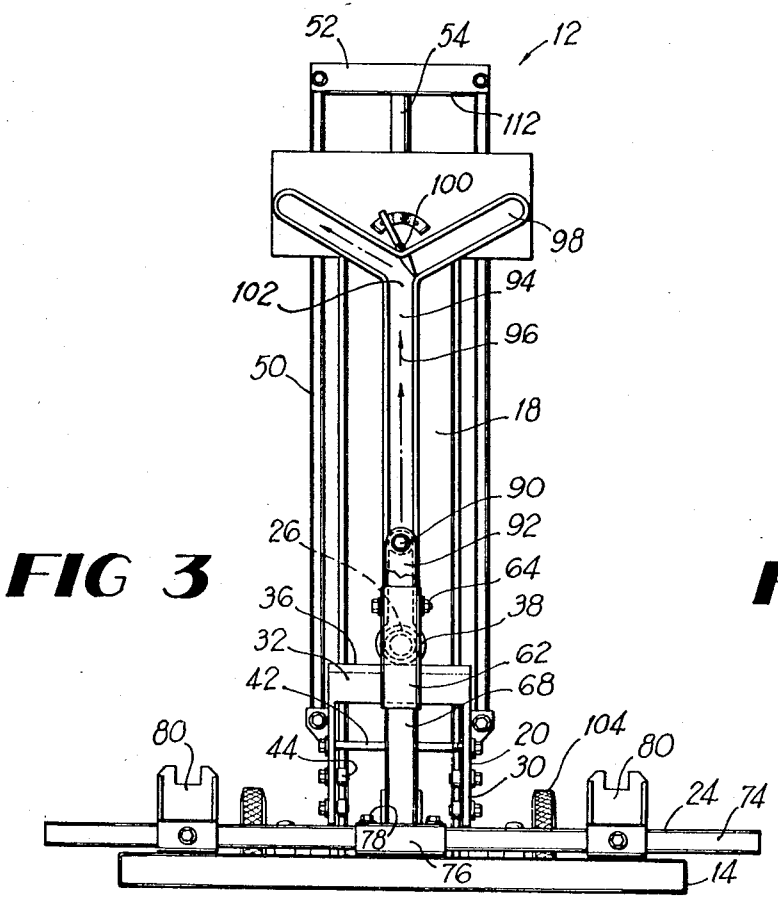
FIGS. 3 is a front elevational view of the preferred embodiment of the vehicle lift of the present invention with the vehicle support rack in the unrotated position.

FIG. 1 shows vehicle 10 being lifted by lifts 12 of the present invention acting in concert. As shown in FIGS. 1 and 2, a frame 14 supports an upright 18 on each lift along which a carriage 20 slides. Carriage 20 is moved up and down the upright 18 by an actuator 22. A vehicle support rack 24 is fastened or connected to the underside of vehicle 10 and is connected to a journal 26 which rests upon and rotates upon a portion of carriage 20. Vehicle support rack 24 is adjusted and connected to vehicle 10 in such a manner that journal 26 is aligned or substantially aligned, both vertically and horizontally, to the vehicle's center of gravity 28. Accordingly, when vehicle 10 is lifted by lifts 12 to an appropriate height to allow it to clear the ground and frame 14, it may be rotated about the axis formed by the two journals 26 with a minimum of force.

Figure 7:
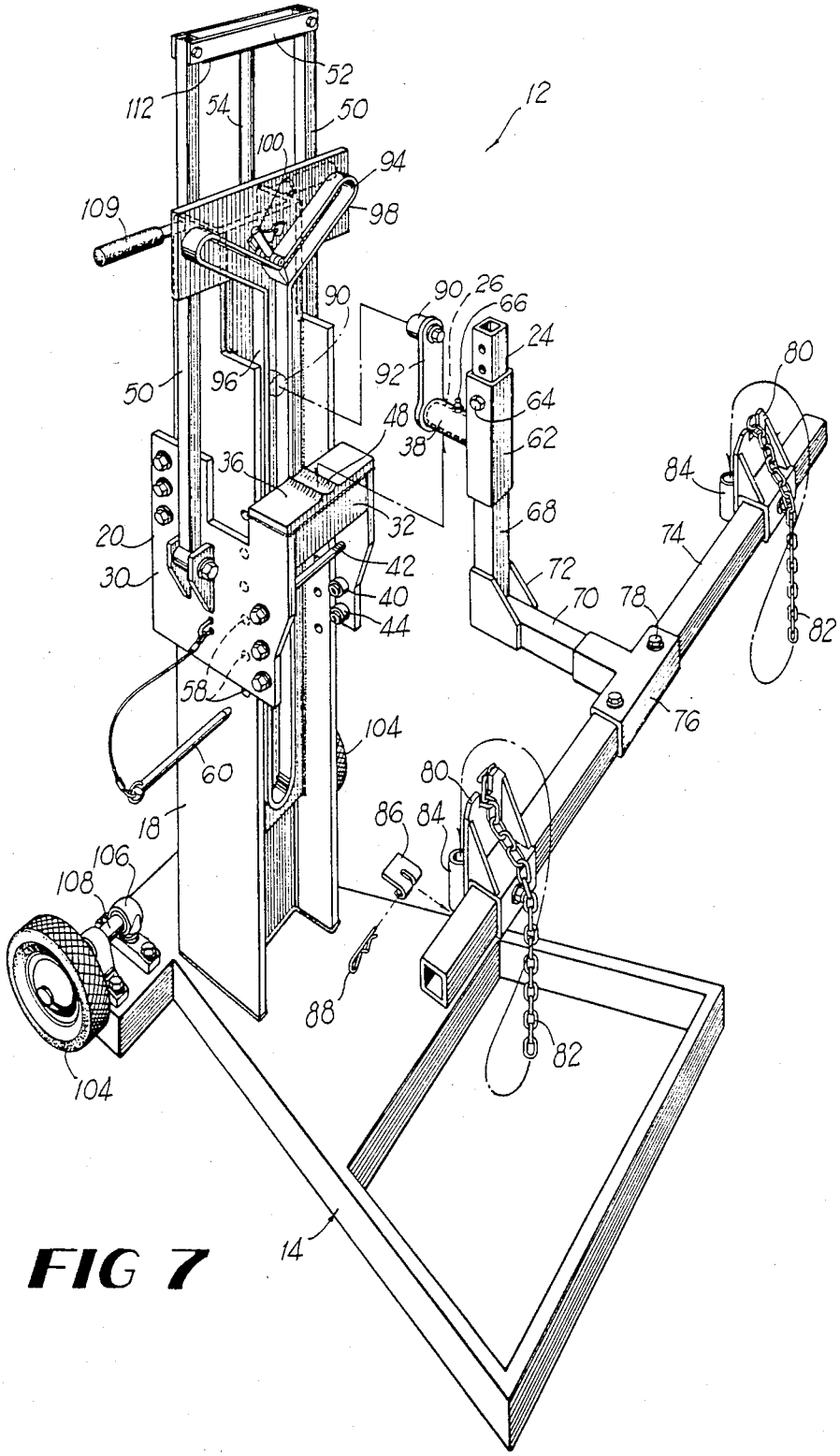
FIG. 7 is a partially exploded perspective view of the lift of FIG. 3.

FIG. 7 shows the structure of the preferred embodiment of lift 12 of the present invention in greater detail. Upright 18 is the central structure member of lift 12. It may be formed of built up metal plating, of metal channel, by cutting away portions of an I-beam where desired or by other appropriate means.

Upright 18 slidably supports carriage 20, which may be built up of cut metal plating welded to form a generally box-like structure. Two like face plates 30 may be cut and joined by welding, bolting or other appropriate means with transverse members 32 to form carriage 20. A horizontal support plate 36 forms one horizontal upper surface of carriage 20 and supports collar 38 which may be formed of metallic tubing and welded to support plate 36. Corresponding holes 40 may be drilled or otherwise formed in face plates 30 to receive guide roller axles 42 which support guide rollers 44. Guide rollers 44 allow carriage 20 to slide along upright 18 easily, especially when carrier 20 bears large forces. In the preferred embodiment, guide rollers 44 on the side of carriage 20 to which collar 38 is connected, and which therefore supports the weight of vehicle 10, are positioned lower on carriage 20 than guide rollers 44 located on the other side of carriage 20, so that guide rollers 44 acting on upright 18 will counteract the rotational force on carriage 20 caused by vehicle 10 and collar 38 rotating support plate 36 toward vehicle 10. In the preferred embodiment, two shoulders 48 which are generally triangular in shape and of cut metal plate are welded to each face plate 30 to provide a connection for a carriage arm 50 used to connect carriage 20 to actuator 22. In the preferred embodiment, carriage arms 50 are metal box tubes having truncated tubing welded at one end through which a bolt is placed to connect carriage arm 50 to shoulder 48. The upper portions of carriage arms 50 are connected by cross members 52 by welding or bolts, and cross members 52 connect to actuator 22. The length of carriage arms 50 will be determined by the length of actuators 22, which in turn will be determined by the desired range of travel of carriage 20 and the corresponding maximum height deemed necessary to lift vehicles 10 in order to rotate them. Generally, the length of carriage arms 50 will be approximately the length of actuator 22, if actuator 22 is a hydraulic cylinder or a compressed air cylinder, since the piston 54 to which arms 50 are connected travels approximately the length of the cylinder 56 to maximum extension.

Retaining holes 58 may be drilled or formed in upright 18, through which a retaining pin 60 may be placed to restrain carriage 20 from inadvertently moving downward on upright 18 while lift 12 is supporting a vehicle 10. Retaining holes 58 may be placed at predetermined positions in order to allow vehicle support rack 24 and vehicle 10 to be halted at varying degrees of rotation as carriage 20 is raised or lowered.

Extending through collar 38 which is mounted on support plate 36 of carriage 20 is a journal 26 of vehicle support rack 24 which in turn is connected at approximately a right angle, or normal, to a sleeve 62. Sleeve 62 in the preferred embodiment is formed of box tubing having at least one pair of corresponding holes formed therein for receiving a bolt or pin 64. Collar 38 may have a grease fitting 66 attached in order to lubricate the bearing surfaces of journal 26 and collar 38, to promote and ease rotation of journal 26. Sleeve 62 adjustably and slidably receives a connector bar 68 which in turn is mounted at approximately a right angle or normal to an extender bar 70. Elbow plates 72 may be attached at the intersection of connector bar and extender bar to rigidify the structure of vehicle support rack 24. A plurality of corresponding holes are drilled or otherwise formed in connector bar 68 so that connector bar 68 may be adjustably mounted within sleeve 62 to allow vehicle support rack 24 to be adjusted so that journal 26 will be substantially aligned with center of gravity 28 of vehicle 10. Mounted preferably adjustably normal to extender bar 70 is a support bar 74 which is connected to the undercarriage of vehicle 10. Support bar 74 may be adjustably connected to extender bar 70 by means of a T fitting having holes and a bolt or pin 78, the pin 78 to be received in corresponding holes in extender bar 70.

Attached adjustably by corresponding holes and bolts or pins to support bar 74 are chain tensioners 80 to which chain 82 is connected. In the preferred embodiment, tensioners 80 are built up plates extending upwardly from support bar 74 and having locking tubes attached through which chain 82 may pass and be held in place by stop plates 86 and a clevis 88. Other means for supporting, tensioning and locking chain 82 may be provided, including notches in chain tensioners 80 through which links of chain 82 may be placed, hooks connected to chain tensioners 80 which hold links of chain 82, or bolts used in place of stop plates 86 and clevis 88.

Connected rigidly in the preferred embodiment to the end of journal 26 not connected to sleeve 62 is a means for mounting a follower 90 at a desired radial distance from the center of rotation of journal 26. In the preferred embodiment, such means is a web of cut metal plate or follower link 92 whose one end is welded to journal 26 and whose other end is formed with a hole to receive the follower 90 assembly. Follower 90 is preferably a roller having a bolt axle which may be received by the hole in the follower link 92 to support follower 90 rigidly. Although proper use of lift 12 requires that the journal 26 be aligned substantially with the center of gravity 28 of vehicle 10, careless use may result in misalignment of journal 26 and thus require follower 90, follower link 92, journal 26 and sleeve 62 to absorb large shear forces and twisting moments. Accordingly, these components are formed and connected to one another to withstand such large forces and moments and should be structurally sturdy.

In the preferred embodiment, follower 90 is controlled by follower track 94 which receives it as carriage 20, and therefore it and journal 26, travel up and down upright 18. Follower track 94 is a Y-shaped channel which may be formed by looping a length of metal strip into a Y-shape, the trunk 96 of the Y approximately the length of travel of carriage 20, each arm 98 of the Y to form an angle between the arm and the trunk of approximately 120 degrees. Follower track 94 is preferably welded onto upright 18 and any supporting plates necessary to hold follower track 94 in place. The interior width of the trunk 96 and each arm 98 is approximately the width of follower 90 so that follower 90 and vehicle support rack 24 may be closely and accurately controlled by the cooperation of follower 90 and follower track 94. A selector lever 100 is pivotally mounted in the divergence 102 between the two arms 98 of follower track 94 to divert or force follower 90 into one arm 98 or the other arm 98 of follower track 94 in order to cause vehicle support rack 24 and vehicle 10 to rotate in one direction or the other. Arms 98 may have other configurations; they may be curved in order to vary the rate at which vehicle 10 rotates given a certain height relationship of carriage 20 and upright 18, but in any event should be configured so that vehicle support rack 24 and vehicle 10 do not rotate until sufficiently lifted to clear frame 14 and the ground or surface on which lift 12 is placed. Because follower track 94 holds follower 90, follower link 92, journal 26 and therefore vehicle support rack 24 and vehicle 10 in place during rotation, follower track 94 is of structurally sturdy material and sturdily mounted to upright 18 to compensate for forces caused by improper alignment of journals 26 with center of gravity 28 of vehicle 10.

Figure 9:
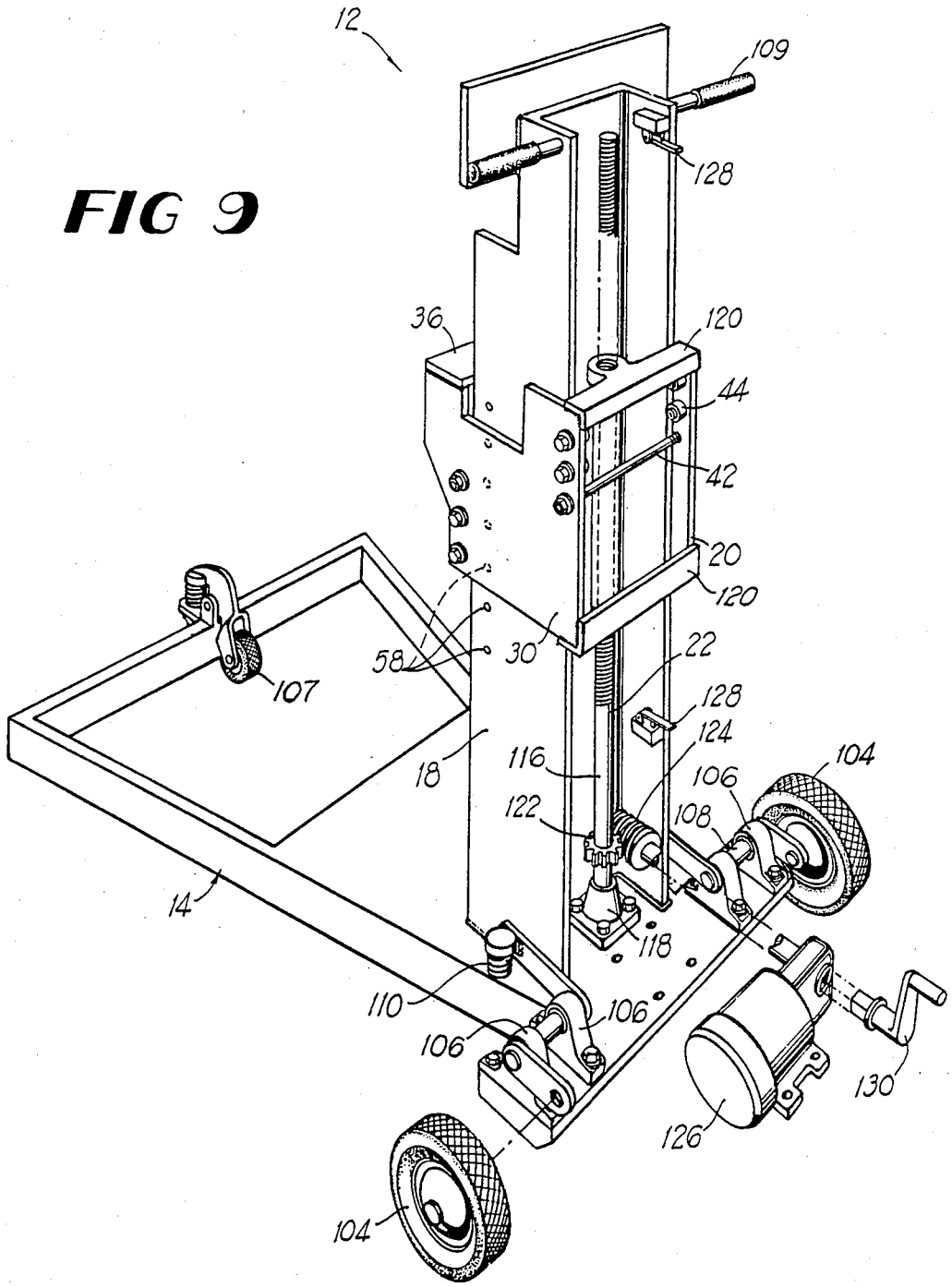
FIG. 9 is a perspective view of an alternate embodiment of the vehicle lift of the present invention showing a power driven jack screw used in place of the hydraulic cylinder.

Upright 18 is mounted on frame 14 which supports it and lift 12 in general. Frame 14 in the preferred embodiment is a generally triangular shaped web formed of welded metal channels and plates, its width being sufficient to provide stability during all phases of rotation of a large range of vehicles 10. Frame 14 extends a sufficient distance on the vehicle support rack 24 side of upright 18 to prevent lift 12 from tipping as lift 12 is lifting and rotating a vehicle 10. Frame 14 may be provided with wheels or casters 104 to allow lift 12 to be stored and easily moved into place. Wheels 104 must be sturdy and sturdily mounted to frame 14 as by the use of at least one trunnion 106 to absorb downward forces placed on lift 12 by vehicle 10 of approximately slightly less than one-half the weight of the heaviest vehicle contemplated to be lifted by the lift 12. In a preferred embodiment as shown in FIG. 9, wheels 104 should be able to withstand approximately 2,500 pounds of weight, are connected to axles 108 and are pivotally mounted in trunnions 106 through which axles 108 extend. The end of each axle 108 is supported by a suspension coil 110 mounted to frame 14, in such a manner that when weight is applied to lift 12, wheels 104 pivot upwardly to allow frame 14 to rest on the supporting surface. A similarly mounted caster 107 on frame 14 opposite wheels 104 allows lift 12 to be rolled and easily maneuvered. Similarly, as shown in FIG. 7, trunnions 106 may be attached to coils 110. This arrangement provides a degree of flexibility and resilience to frame 14 and thereby reduces shock and metal fatigue to all components of lift 12 which would otherwise be caused by rapid application of large forces from the weight of vehicle 10 and action of actuator 22. Handles 109 may be added to allow additional portability.

With reference to FIG. 7, a hydraulic cylinder such as is conventional in the art is provided as actuator 22. In the preferred embodiment, piston 54 of cylinder 56 is connected to cross members 52 by means of butt plate 112 to absorb and distribute the large nearly point force placed on cross members 52 by piston 54. The lower end of cylinder 56 is connected to frame 14 by shoulders 114 through which a bolt passing through the end of cylinder 56 is threaded. Alternatively, a compressed air actuated cylinder such as is conventional in the art may be used in place of hydraulic cylinder 56.

In an alternate embodiment shown in FIG. 9, actuator 22 takes the form of a jack screw 116 held in place on frame 14 by thrust-bearing or pillow block 118 and threadably received by bolt plate 120 traversing the face plates 30 of carriage 20. Preferably, more than one bolt plate 120 is utilized and the threaded portions of bolt plates 120 are preferably connected by a rigid means as shown in FIG. 9 to add structural integrity. Jack screw 116 is rotated by worm gear 122, which is rigidly attached to it, and which is in turn rotated by means of a roller 124 operated by a power device 126 such as an electric motor or hydraulic motor. As shown in FIG. 9, a hand crank 130 may be used for manual operation of lift 112 in the event of power loss or inoperability of power device 126. Also as shown in FIG. 9, limit switches 128 may be positioned on upright 18 or other appropriate locations to deactivate power device 126 when selected portions of carriage 20 reach their limits of travel.

In an additional embodiment, a portion of a chain loop suspended between two sprockets rotatably mounted to upper and lower portions of upright 18 is attached to carriage 20. Power device 126 acting through reduction gears powers the chain loop to lift and lower carriage 20. Limit switches 128 may be used.

Figure 5:
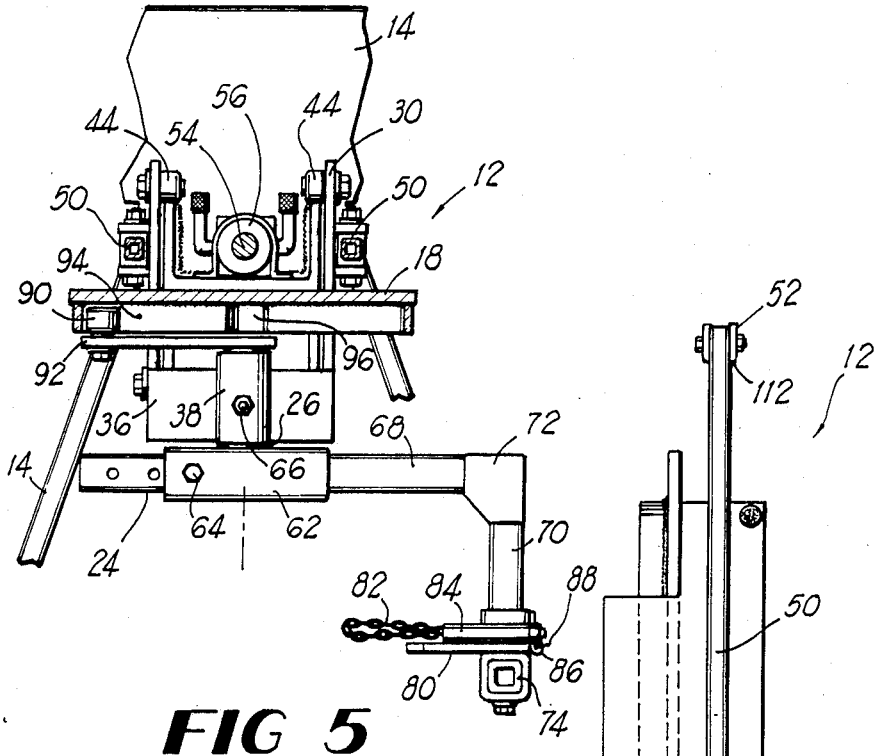
FIG. 5 is a cross-sectional view of the lift of FIG. 4, taken along line 5—5 of FIG. 4.
Figure 6:
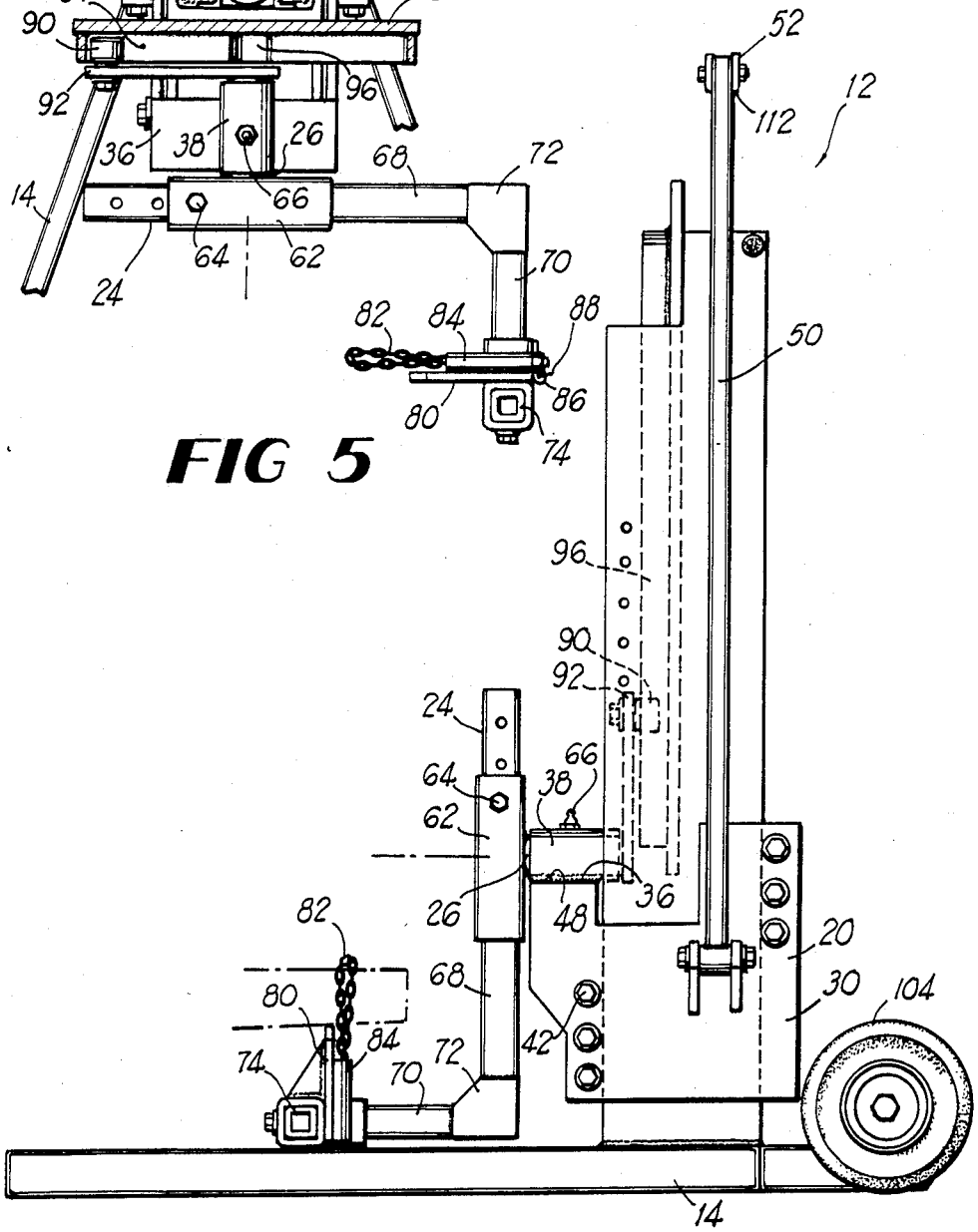
FIG. 6 is a side elevational view of the lift of FIG. 3.

With reference to FIG. 5, follower 90 can be seen located within one arm 98 of follower track 94 to rotate vehicle support rack 24 to the 90 degree rotated position. FIG. 6 shows chain tensioners 80 and chain 82 connected to a structural component of a vehicle 10, while lift 12 is in the lowered position.

Figure 8:
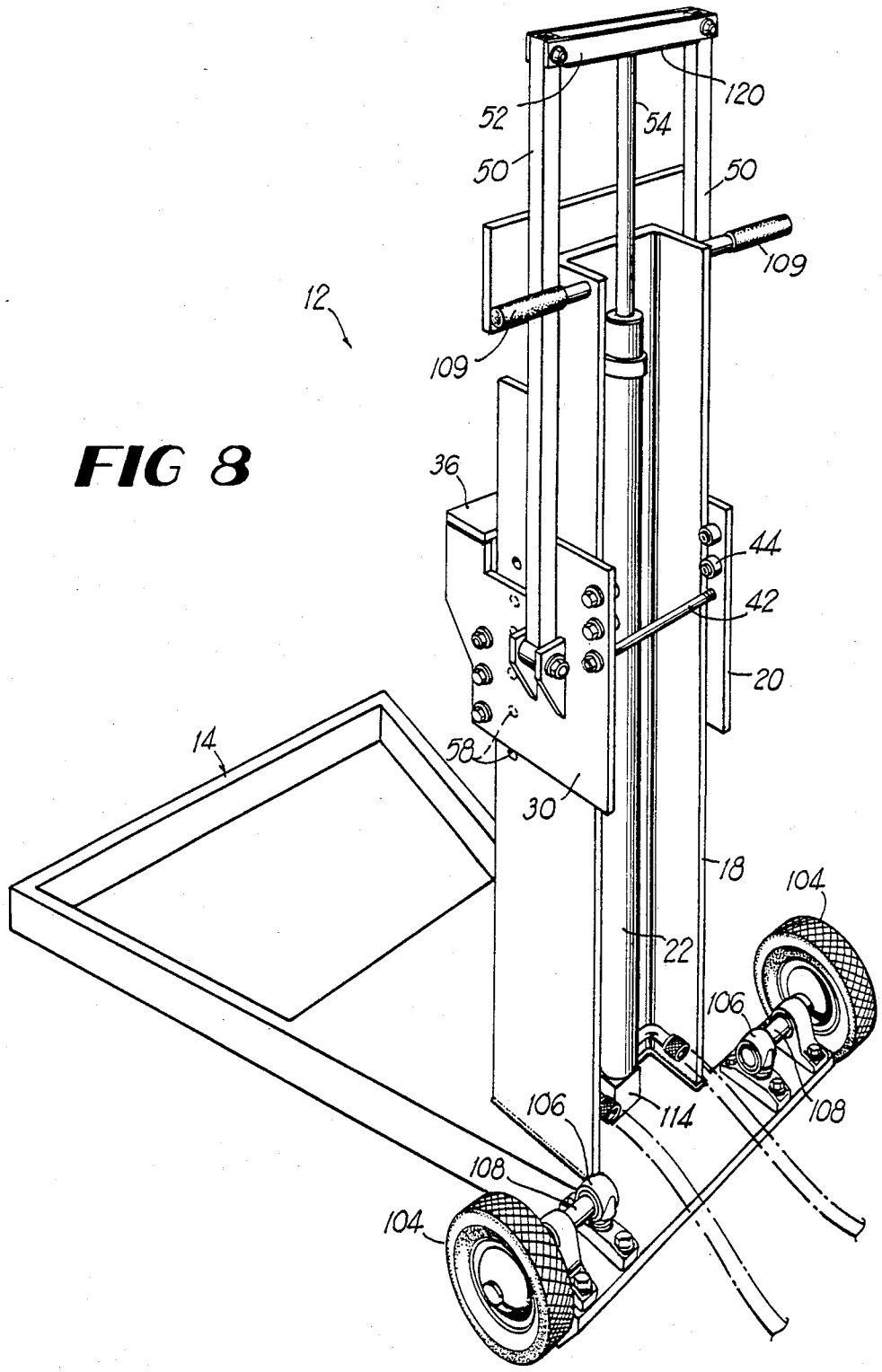
FIG. 8 is a perspective view of the lift of FIG. 3 illustrating the hydraulic cylinder which actuates the device.

With reference to FIG. 8, lift 12 is operated by actuating actuator 22, as, for instance, by providing hydraulic power to hydraulic cylinder 56, compressed air to compressed air actuated cylinder 56, or power to power device 126 to move or push carriage 20 up upright 18. The preliminary step, of course, and important to the functioning of lift 12 is to connect the vehicle support rack to vehicle 10 so that journal 26 is substantially aligned with the center of gravity 28 of vehicle 10. This may be accomplished by varying the positions of chain tensioners 80 along support bar 74, varying the configuration of support bar 74 on extender bar 70 and adjusting the extender bar 70-sleeve 62 connection. Actuator 22 on each lift 12 holding vehicle 10 may be simultaneously actuated by simultaneously providing hydraulic power, air or other power to actuator 22 as by appropriate conventional fluid equal flow dividers, valves and T fittings or wiring. As carriage 20 travels up upright 18, follower 90 travels in follower track 94 until it reaches selector lever 100 which has been preset to force follower 90 into one arm 98 or the other and thereby control rotation of vehicle 10. As follower 90 progresses into an arm 98 and journal 26 continues upward, the horizontal distance between follower 90 and journal 26 becomes smaller, and vehicle support rack 24 rotates. Carriage 20 may be stopped and locked in place by retaining pin 60 in retaining holes 58 of upright 18, as vehicle 10 is rotated to the desired position. As carriage 20 continues to travel up upright 18, follower 90 and journal 26 eventually become horizontal with respect to one another after journal 26 travels above the convergence of the two arms 98 of the follower track 94. At this point, vehicle 10 has rotated to its 90 degree position and carriage 20 may be locked in place with retaining pin 60 in retaining holes 58 of upright 18.

To lower vehicle 10, retaining pin 60 is removed and hydraulic power or air is decreased to actuator 22, or jack screw 116 is rotated in reverse. Follower 90 descends follower track 94 and once again becomes vertical with respect to journal 26 before vehicle 10 is sufficiently lowered so that it does not clear frame 14 or the supporting surface of lift 12.

The foregoing is intended to explain, describe and illustrate the invention, and modifications and variations may be made on the embodiments described above without departing from the scope and spirit of the invention.

I claim:

1. A vehicle lift for lifting and rotating vehicles, comprising:

(a) a frame for supporting the lift;
(b) an upright extending substantially vertically from the frame;
(c) a y-shaped follower track mounted on the upright;
(d) a carriage slidably connected to the upright;
(e) a vehicle support rack which may be connected to the vehicle to be lifted and which is rotatably mounted to the carriage, comprising:
(i) a collar mounted on the carriage;
(ii) a journal rotatably mounted in the collar;
(iii) a sleeve mounted on the journal;
(iv) a connector bar adjustably received and mounted in the sleeve for adjusting the vehicle support rack such that the center of gravity of the vehicle being lifted and rotated is substantially aligned with the journal and the collar, whereby the vehicle may be easily rotated and easily restrained from rotating;
(v) an extender bar mounted substantially normal to the connector bar;
(vi) a vehicle support bar mounted adjustably and substantially normal to the extender bar, for connection to the vehicle being lifted and rotated;
(vii) connector means mounted on the vehicle support bar for securing the vehicle to the vehicle support bar;
(viii) a follower link mounted on the journal; and
(ix) a follower rotating mounted on the follower link for being received in the follower track and thereby controlling rotation of the vehicle; and
(f) an actuating means connected to the carriage for pushing the carriage up and down the upright.

2. A vehicle lift according to claim 1 wherein said upright further comprises a plurality of openings formed therein and a pin for insertion in the openings, whereby the carriage is restrained from inadvertently being lowered on the upright, and whereby the vehicle may be restrained in a predetermined rotated position.

3. A vehicle lift for lifting and rotating vehicles, comprising:

(a) a frame for supporting the lift;
(b) a plurality of wheels connected to the frame for allowing the lift to be moved easily;
(c) an upright extending substantially vertically from the frame;
(d) a y-shaped follower track mounted on the upright;
(e) a carriage slidably connected to the upright;
(f) a plurality of openings formed in the upright and a pin for insertion in the openings for restraining the carriage from being inadvertently lowered down the upright;
(g) a collar mounted on the carriage;
(h) a vehicle support rack rotatably connected to the collar, comprising:
(i) a journal rotatably mounted in the collar;
(ii) a sleeve mounted in the journal;
(iii) a connector bar adjustably received in the sleeve for adjusting the vehicle support rack such that the center of gravity of the vehicle being lifted and rotated is substantially aligned with the journal and the collar, whereby the vehicle may be easily rotated and restrained from rotating;
(iv) an extender bar mounted substantially normal to the connector bar;
(v) a vehicle support bar mounted adjustably and substantially normal to the extender bar, for connection to the vehicle being lifted and rotated;
(vi) at least one chain and corresponding tensioner adjustably mounted on the vehicle support bar for securing the vehicle support bar to the vehicle;
(vii) a follower link mounted on the journal; and (viii) a follower rotatably mounted on the follower link for being received in the follower track and thereby controlling rotation of the vehicle;

(i) a selector lever pivotally mounted in the divergence of the arms of the y-shaped follower track, to divert the follower into a preselected arm of the track and thereby cause the vehicle to rotate in a preselected direction; and (j) an actuating means connected to the carriage and to the frame for causing the carriage to slide up and down the upright and lift and rotate the vehicle.

4. A vehicle lift according to claim 3 wherein said carriage further comprises a plurality of carriage arms extending substantially vertically upward from the carriage and at least one cross-member connecting the carriage arms, and said actuating means is a hydraulic cylinder connected to the frame and the cross-member.

5. A vehicle lift according to claim 3 wherein said carriage further comprises a plurality of carriage arms extending substantially vertically upward from the carriage and at least one cross-member connecting the carriage arms, and said actuating means is a compressed air actuated cylinder connected to the frame and the cross-member.

6. A vehicle lift according to claim 3 wherein said actuating means comprises a jackscrew rotatably connected to the frame and threadably and rotatably connected to the carriage, and a power means to turn the jackscrew.

7. A vehicle lift according to claim 6 further comprising at least one limit switch connected to the upright to limit the travel of the carriage by deactivating said power means.

8. A vehicle lift for lifting and rotating vehicles comprising:

(a) a frame means for supporting the lift;

(b) an upright means extending substantially vertically from the frame means;

(c) a carriage means slidably connected to the upright means;

(d) a vehicle support rack means which is connected to the vehicle to be lifted, which is rotatably mounted to the carriage means, and which may be adjusted to substantially align the center of gravity of the vehicle being lifted and rotated with the point at which the vehicle support rack means is rotatably mounted to the carriage means;

(e) a y-shaped follower track mounted on the upright means;

(f) follower link means connected to the vehicle support rack means;

(g) follower means mounted on the follower link means for being received in the y-shaped follower track and thereby controlling rotation of the vehicle; and (h) a selector lever pivotally mounted between the arms of the y-shaped follower track, to direct the follower into a preselected arm of the track and thereby control the direction of rotation of the vehicle.

* * * * *